United States Patent [19]

Hull et al.

[11] Patent Number: 5,014,379

[45] **Date of Patent: * May 14, 1991**

[54] COMBINATION TOOL

[76] Inventors: Harold L. Hull, 401 Canyon Way, Sp. 43, Sparks, Nev. 89434; Robert D. Montgomery, 1685 W. 12th, Reno, Nev. 89503

[ * ] Notice: The portion of the term of this patent subsequent to Feb. 26, 2008 has been disclaimed.

[21] Appl. No.: 439,245

[22] Filed: Nov. 20, 1989

[51] Int. Cl.[5] ..... B25F 1/02

[52] U.S. Cl. ..... 7/127; 7/107; 7/130

[58] Field of Search ..... 7/126–128, 7/130, 107; 81/427.5

[56] References Cited

U.S. PATENT DOCUMENTS

| | | | |
|---|---|---|---|
| D. 255,539 | 6/1980 | Graham | D8/22 |
| D. 281,216 | 11/1985 | Cuttiff Jr. | D8/26 |
| 955,370 | 4/1910 | Sullivan | 7/130 X |
| 2,578,230 | 12/1951 | Davis | 7/130 X |
| 3,392,767 | 7/1968 | Stillwagon | 81/438 X |
| 3,946,453 | 3/1976 | Torres | 7/4 |
| 4,096,896 | 6/1978 | Engel | 81/438 X |
| 4,238,862 | 12/1980 | Leatherman | 7/128 |
| 4,283,805 | 8/1981 | Stacy | 7/127 |
| 4,741,059 | 5/1988 | Lee | 7/127 |
| 4,842,025 | 6/1989 | Box | 140/119 |

FOREIGN PATENT DOCUMENTS

| | | | |
|---|---|---|---|
| 1064990 | 12/1953 | France | 7/127 |

*Primary Examiner*—James G. Smith

[57] ABSTRACT

A combination tool which is substantially a pair of pliers in which the handles are parallel to each other and have at their handle ends screwdriver tips and have a free floating rubber sleeve on each handle which may be gripped to put pressure on the screwdriver tips while one of the handles being turned crossways acts as a torque wrench. In one embodiment, the tips may be changeable and held in place by magnetic or mechanical means.

9 Claims, 2 Drawing Sheets

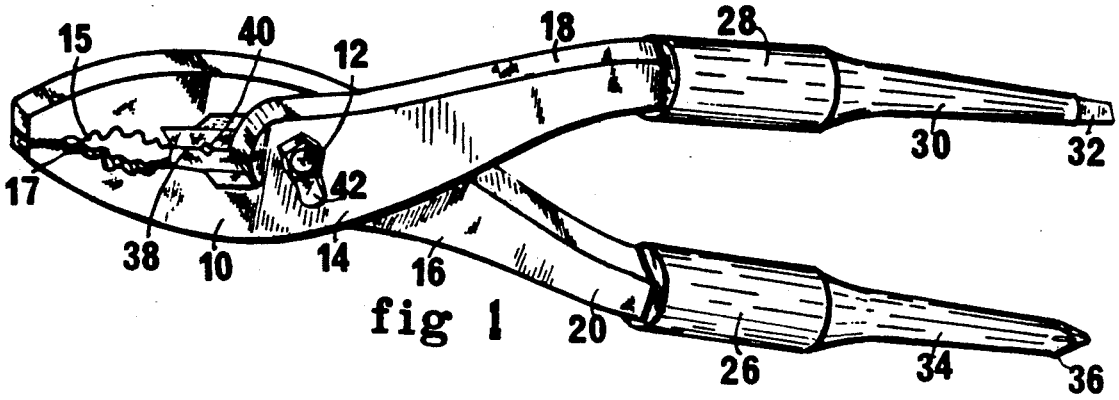
fig 1
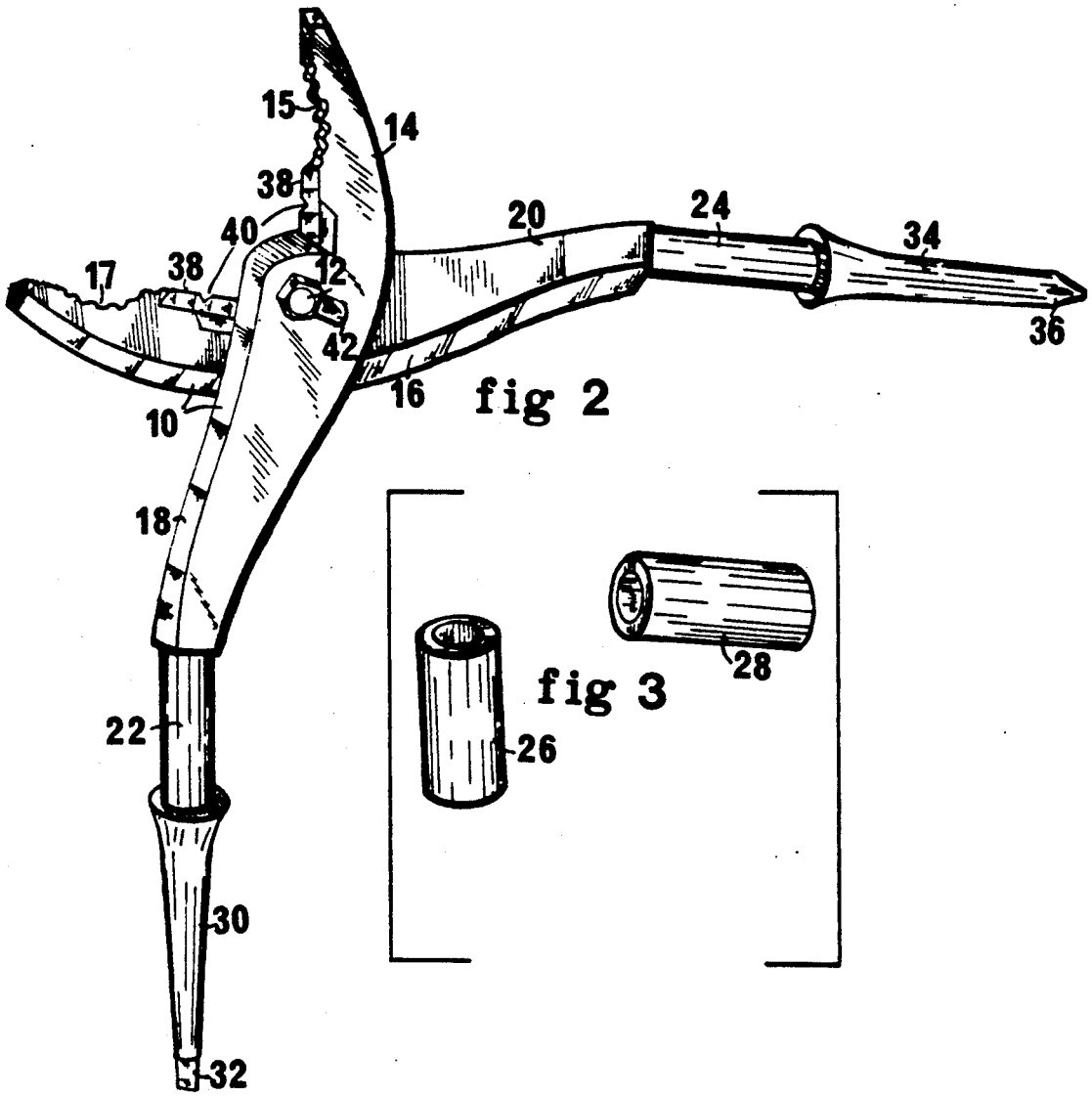
fig 2
fig 3

COMBINATION TOOL

This invention relates to a combination tool and more particularly to a combination tool involving pliers, a wire stripper, a cutter and screwdrivers.

BACKGROUND OF THE INVENTION

In the past many combination tools have been taught which involve using the gripping action of pliers to not only grip but to cut, strip, lock onto, or other wise engage an object while at the same time using one or all of the distal ends of the pliers for use as another tool such as a wrench or screwdriver.

Although combination tools have been known for many years and have the advantages of convenience and lighter weight over separate tools to do the same jobs, they have generally achieved these advantages at the cost of efficiency for one or more of the specific tasks for which they are adapted, This is, in attempting to be jacks of all trades, they are rarely able to master even one. For example, the tools shown in U.S. Pat. Nos. 1,321,777 and 1,739,658 feature a screwdriver blade at the end of one of the handles of a pliers as also does, U.S. Pat. No. Des. 281,216 and U.S. Pat. No. Des. 255,539. Now as anyone who has used such a tool as a screwdriver will attest, this arrangement is far from satisfactory. The main drawback is the requirement that the user grip the sharp jaws of the pliers when applying pressure down on the screw to be driven.

Also, the prior art when using the handle of the pliers as a screwdriver have designed the handle with generally a curved handle which does not allow the screwdriver to engage the screw in a perpendicular manner but the pliers must be held at an angle and when used as a screwdriver the pliers end must swing through an arc in order to keep the screwdriver squarely in the fastener.

U.S. Pat. No. 3,946,453 approaches this problem by placing the screwdriver on one of the jaws of the pliers but now the depth of the handle is sacrificed and only surface screws can be addressed.

SUMMARY OF THE INVENTION

In overcoming these disadvantages of the prior art and in achieving other advantages, a combination tool made in accordance with the present invention includes a first and second plier member, each having a jaw section and handle section. The members are pivotably attached together to allow the jaws to move together in the conventional manner. However, the handle sections are so designed as be perpendicular to the head of the fastener when used as a screwdriver and means to grasp the handle at a point other than the jaw section is provided. The member not engaging the fastener is turned substantially perpendicular to the first plier member and the plier members are interconnected so that when one of the screwdriver point associated with the plier member is used, the second plier member may be used by the user to more easily apply torque to the screwdriver point and fastener.

It is therefore, a primary object of the present invention to provide a combination tool which can serve as a conventional pliers without sacrificing any convenience and yet be used as a leveraged screwdriver without sacrificing the advantages of a conventional leveraged screwdriver and by using both handles as screwdrivers, two different types of screwdrivers are provided.

It is another object to provide a combination tool in which the handles are parallel to each other and perpendicular to the head of the fastener.

It is yet another object to provide means other than the jaw section to apply pressure to the screwdriver tips.

Still another object in a second embodiment is to provide an independent gripping area which surrounds each of the two handles areas which turn freely on the handle thus providing a "speed wrench" feature.

Yet another object is provide a wire stripper in conjunction with the jaw members.

Still another object is to provide a cutting edge in conjunction with the jaw members.

Another object is to provide a rubber or vinyl sleeve which can be forced over a tapered end of the handle into a recessed area of the handle, and be held, yet turn freely.

Still another object is to provide a tool which can be formed in two pieces or can be fabricated.

Other objects and advantages will become obvious when taken in consideration with the following drawings.

DESCRIPTION OF THE DRAWINGS

FIG. 1 is a perspective view of a preferred embodiment of the present invention.

FIG. 2 is a perspective view of a preferred embodiment of the present invention.

FIG. 3 is a perspective view of handle covers.

DETAILED DESCRIPTION OF THE DRAWINGS

Figure 4:
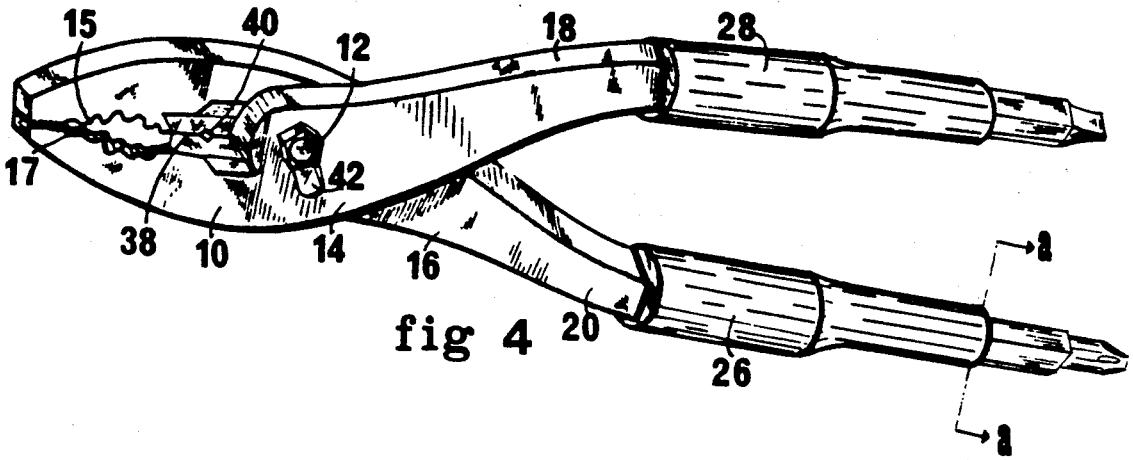
FIG. 4 is a perspective view of a second embodiment of the present invention.

Referring now in detail to the drawings wherein like numerals refer to like parts throughout the various views, at FIG. 1 is depicted one embodiment of a combination tool, generally indicated by the numeral 10, and constructed in accordance with the present invention the tool 10 includes a pair of pivoted, at 12, plier members 14 and 16, each of which include in a conventional manner a jaw section 15 and 17, respectively and handle section 18 and 20, respectively, while 22 and 24 are sections of the handles which are rounded to receive gripping members 26 and 28, and 30 is a section on the handle that tapers to a slot screwdriver member 32 while 34 is a section on the handle that tapers to a phillips screwdriver member 36. 42 is an elongated slot to provide, in the conventional manner, two positions for the jaws, one position being more open than the other.

FIG. 2 shows the present invention being used as a screwdriver with one handle section at substantially a 90 degree angle to the other. It will be noted that the gripping members may be gripped with one hand (thumb and two fingers) in order to put pressure on and hold the screwdriver forcefully against a fastener (not shown), while the other hand grasps the second handle which may be used as turning handle which gives more torque than a conventional screwdriver. Also the device may now be used as a "speed wrench" as the gripping members 26 and 28 are a loose fit and turn freely on section 22 and 24 of the handles. The gripping members may be made of a flexible material such as rubbber or vinyl which can be forced over the tapered sections 30 and 34 and then fit loosely in sections 22 and 24. It will also be noted that when the gripping members are in place on the handle, that they provide a smooth, comfortable surface to grip when the device is used as pliers or as a stripper or cutting tool.

FIG. 4 shows yet another embodiment in which the device is substantially the overall configuration with the added features of having removable tips such as the slot screwdriver tip 44 and phillips tip 46.

Figure 5:
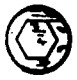
FIG. 5 is a section taken on line a″—a″ of FIG. 4.
Figure 6:
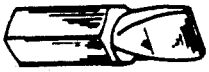
FIG. 6 is a magnetic slot type screwdriver tip.
Figure 7:
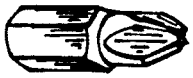
FIG. 7 is a magnetic phillips type screwdriver tip.

FIG. 5 is a view taken at section a"—a" which shows the coupling means 48 to engage and hold the various screwdriver tips. The coupling means may be made magnetic to hold the tips in place or other conventional means may be used. Many types of tips may be used including reversible tips and no attempt is made to catalog them, and the use of a slot screwdriver and a phillips screwdriver tip is by example only.

It will now be seen that we have provided a new, novel, and valuable combination tool which is substantially made in two pieces by drop forging or casting and which overcomes the disadvantages of the prior art. One embodiment of the present invention provides in combination, pliers, which are easily gripped by the rubber or vinyle handles for a comfortable grip, a cutting tool, a stripping tool, a phillips screwdriver and a slot screwdriver. In one embodiment the rubber or vinyl gripping member may be dispensed with, leaving a fire proof tool for use by fireman or the like. Yet another embodiment provides means to use many different tips to become a very versatile tool.

It will also be noted that we have provided a tool in which the handles are parallel to each other to allow the tool to approach the fastener at substantially a 90 degree angle.

We have also provided an excellent and comfortable means to apply pressure to the work piece or driver points.

Also we have provided a gripping area that does not turn with the device allowing the device to act as a "speed wrench".

Although the invention has been herein shown and described in what is conceived to be the most practical and preferred embodiment, it is recongnized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by Letters Patent is:

1. A combination tool comprising; a first and second plier member having a jaw section and a handle section, said jaw sections having cutting edges, said cutting edges being aligned so that they coact to cut an object placed between them when said jaw sections are pivotable displaced toward and away from each other, said plier members being pivotally attached together to allow said jaw sections to be pivotally displaced toward and away from each other by moving said handle sections to and away from each other, said handle section of said first plier member having at its distal end a phillips screwdriver point, said handle of said second plier member having at its distal end a slot screwdriver point, said handle sections being substantially parallel to each other when said plier members are in a first closed position, a gripping area, said gripping area being recessed into said handle section to form an abutment, said gripping area being cylindrical, said gripping area being covered by a sleeve, said sleeve being able to turn freely on said cylindrical area said handle being tapered from said abutment to the distal end of said handle, said gripping area cooperating with said handle sections to allow the thumb and fingers of a user to grasp said gripping area of said handle section of said first plier member to put substantial pressure on said phillips or said slot screwdriver points, while said handle section of said second plier member is pivotable to a second open position substantially perpendicular to said first plier member, and said plier members are interconnected so that when one of said screwdriver points associated with said plier member is in use, said second plier member may be used by said user to more easily apply torque to said screwdriver point.

2. The device of claim 1 in which said sleeve is made of rubber.

3. The device of claim 1 in which said sleeve is made of vinyl.

4. A combination tool comprising; a first and second plier member having a jaw section and a handle section, said jaw sections having cutting edges, said cutting edges being aligned so that they coact to cut an object placed between them when said jaw sections are pivotable displaced toward and away from each other, said plier members being pivotally attached together to allow said jaw section to be pivotally displaced toward and away from each other by moving said handle sections to and away from each other, said handle sections having means at their distal ends to receive and hold releasably attached tips, said handle sections being substantially parallel to each other when said plier members are in a first closed position, a gripping area, said gripping area being recessed into said handle section to form an abutment, said gripping area being cylindrical, said gripping area being covered by a sleeve, said sleeve being able to turn freely on said cylindrical area said handle being tapered from said abutment to the distal end of said handle, said griping area cooperating with said handle sections to allow the thumb and fingers of a user to grasp said gripping area of said handle section of said first plier member to put substantial pressure on said phillips or said slot screwdriver points, while said handle section of said second plier member is pivotable to a second open position substantially perpendicular to said first plier member, and said plier members are interconnected so that when one of said screwdriver points associated with said plier member is in use, said second plier member may be used by said user to more easily apply torque to said screwdriver point.

5. The device of claim 4 in which said means to receive and hold releaseably attached tips is a recessed, multisided cavity, said cavity cooperting with said tips to receive and hold said tips by magnetic means.

6. The device of claim 4 in which said tips have a shape and configuration cooperating with a fastener to mechanically engage said fastener.

7. The device of claim 4 in which said tips are slotted screwdriver tips.

8. The device of claim 4 in which said tips are phillips screwdriver tips.

9. The device of claim 4 in which said tips are reversible.

* * * * *